US005328036A

United States Patent [19]

Douglas

[11] Patent Number: 5,328,036

[45] Date of Patent: Jul. 12, 1994

[54] VIBRATORY SCREENING APPARATUS

[76] Inventor: Patrick J. Douglas, 2 Schools Lane, Santon, Douglas, Isle of Man, United Kingdom

[21] Appl. No.: 989,212

[22] Filed: Dec. 10, 1992

[30] Foreign Application Priority Data

May 28, 1992 [GB] United Kingdom ..... 9211300
Aug. 28, 1992 [GB] United Kingdom ..... 9218414

[51] Int. Cl.[5] ..... B07B 1/44
[52] U.S. Cl. ..... 209/366.5; 209/367
[58] Field of Search ..... 209/366.5, 367; 198/770

[56] References Cited

U.S. PATENT DOCUMENTS 2,964,186 12/1960 Ferrara ..... 209/366.5
4,632,751 12/1986 Johnson et al. ..... 209/366.5

FOREIGN PATENT DOCUMENTS 354571 8/1931 United Kingdom .
377432 7/1932 United Kingdom .
829678 3/1960 United Kingdom .

*Primary Examiner*—Cheryl L. Gastineau
*Attorney, Agent, or Firm*—Workman, Nydegger & Jensen

[57] ABSTRACT

There is disclosed a vibratory screening apparatus comprising a frame having a pair of opposed screen frame sides, a multi-deck screen mounted on the frame sides, and a shaft-driven vibratory mechanism coupled with the screen in order to impart vibration energy thereto so as to assist the screening operation. The vibratory mechanism comprises a pair of stubshafts associated one with each of the frame sides. A respective pair of bearing housings support each stubshaft on each frame side. The bearing housings of each respective pair are spaced apart from each other, and a respective counterweight is mounted on each stubshaft in the space between the housings. The counterweights are rotatable with the stubshaft so as to apply vibration energy to the stubshaft, and therefrom to the screen via the bearing housings and the frame sides. Drive motors are coupled with each stubshaft and are arranged to be driven in synchronism in order to apply synchronous rotary motion to each stubshaft.

10 Claims, 3 Drawing Sheets

VIBRATORY SCREENING APPARATUS

BACKGROUND

1. Field of the Invention

This present invention relates to a screening apparatus for separating portions of a mixture of materials having different sizes. More particularly, the present invention relates to a vibratory screening apparatus wherein vibration energy is used to assist the screening action.

2. Background of the Invention

Vibratory screening apparatus are known in the prior art. In one known design of a vibratory screening apparatus, a shaft-driven vibrating mechanism comprises a single shaft which extends horizontally through a screen frame between opposed frame sides in the space between two screen decks. Each end region of the shaft is mounted on the respective screen side through a bearing housing which is secured to the frame side, and a counterweight is mounted on each free end of the shaft which projects outwardly of the respective bearing housing.

Each counterweight comprises an offset mass. Rotation of the shaft results in application of centrifugal force to the shaft through the counterweights which imparts required vibration energy to the screens of the apparatus.

In this known apparatus, substantial bending moments are applied to the shaft by the counterweights, both by reason of the counterweights being mounted on the outwardly projecting ends of the shafts, and also because of the considerable overall length of the shaft which is required to extend throughout the width of the apparatus between the opposed screen frame sides. This causes the mid-region of the shaft to undergo substantial undesirable deflection. The shaft diameter will have to be of a sufficient size to withstand this applied bending load. Also, there will be feedback to the mountings of the bearing housings on the frame sides which will also have to be suitably robust to bear these loads.

BRIEF SUMMARY AND OBJECTS OF THE INVENTION

The invention seeks to provide a design of a shaft-driven vibratory mechanism which is an improvement over known vibratory mechanisms. An efficient transfer of vibration energy to the screening elements of the apparatus is provided.

According to one aspect of the invention there is provided a vibratory screening apparatus which comprises a frame having a pair of opposed screen frame sides, and at least one screen mounted on the frame sides. A shaft-driven vibratory mechanism is coupled with the screen in order to impart vibration energy thereto so as to assist the screening operation. The vibratory mechanism comprises a pair of stubshafts, the first stubshaft being associated with one of the frame sides and the second stubshaft being associated with the other of the frame sides. A respective pair of bearing housings spaced apart from each other support each stubshaft. A respective counterweight is mounted on each stubshaft in the space between the bearing housings. The counterweights are rotatable with the stubshafts in order to apply vibration energy to the stubshaft, and therefrom to the screen through the bearing housings and the frame sides. Drive means are coupled with each stubshaft for applying rotary motion thereto.

Apparatus according to the invention is able to provide efficient transfer of vibration energy to the screen. By reason of the short length of the stubshafts and the mounting of each stubshaft on each frame side through a pair of spaced bearing housings, the bending loads applied to each stubshaft by each counterweight are reduced as compared with the known arrangement of a single long shaft (and can easily be borne by the housings), and with consequent reduction in deflection applied to each shaft.

Preferably, the drive means coupled with each stubshaft comprises a drive motor coupled with the outward free end of each stubshaft. Desirably, the shafts are driven in synchronism with each other so that the same pattern of vibrations are applied to the screen at each side thereof.

In the preferred embodiment, each motor is hydraulic, one of which will be driven in clockwise rotation, and the other in counter clockwise rotation.

Preferably, the motors comprise gear-type motors which are arranged in parallel to a common pumped supply from one or more pumps. The operation of the motors can then be self-regulated so as to apply vibration energy to each of the two opposed side frames of the screen with such vibration energy being in phase.

However, as an alternative to use of hydraulic motors arranged in parallel, synchronous electric motors may be provided.

According to a further aspect of the invention, there is provided a vibratory screening apparatus which comprises a frame having a pair of opposed screen frame sides, and at least one screen mounted on the frame sides. A shaft-driven vibratory mechanism is coupled with the screen in order to impart vibration energy thereto so as to assist the screening operation. The vibratory mechanism comprises a pair of stubshafts, associated one with each of said frame sides, bearing housings supporting the stubshafts and mounted on the frame sides, a respective counterweight mounted on each stubshaft and being rotatable therewith in order to apply vibration energy to the stubshaft and therefrom to the screen via the bearing housings, and drive motors coupled with each stubshaft and arranged to apply synchronous rotary motion to each stubshaft.

In a preferred arrangement, the screening apparatus will have more than one "screen." Typically, each "screen" will comprise a screen mesh or "deck," arranged one above the other, so as to screen consecutively smaller size fractions of the material supplied to the top deck. The apparatus may also include vibratory screen bars. The motors may be driven at speeds of the order of 1,000 rpm, and typical a throw, or path of oscillation imparted to the screen, may be about 5 mm. Suitable resilient dampers will be arranged to absorb the vibration energy imparted to the screen or screens.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENT

Figure 1:
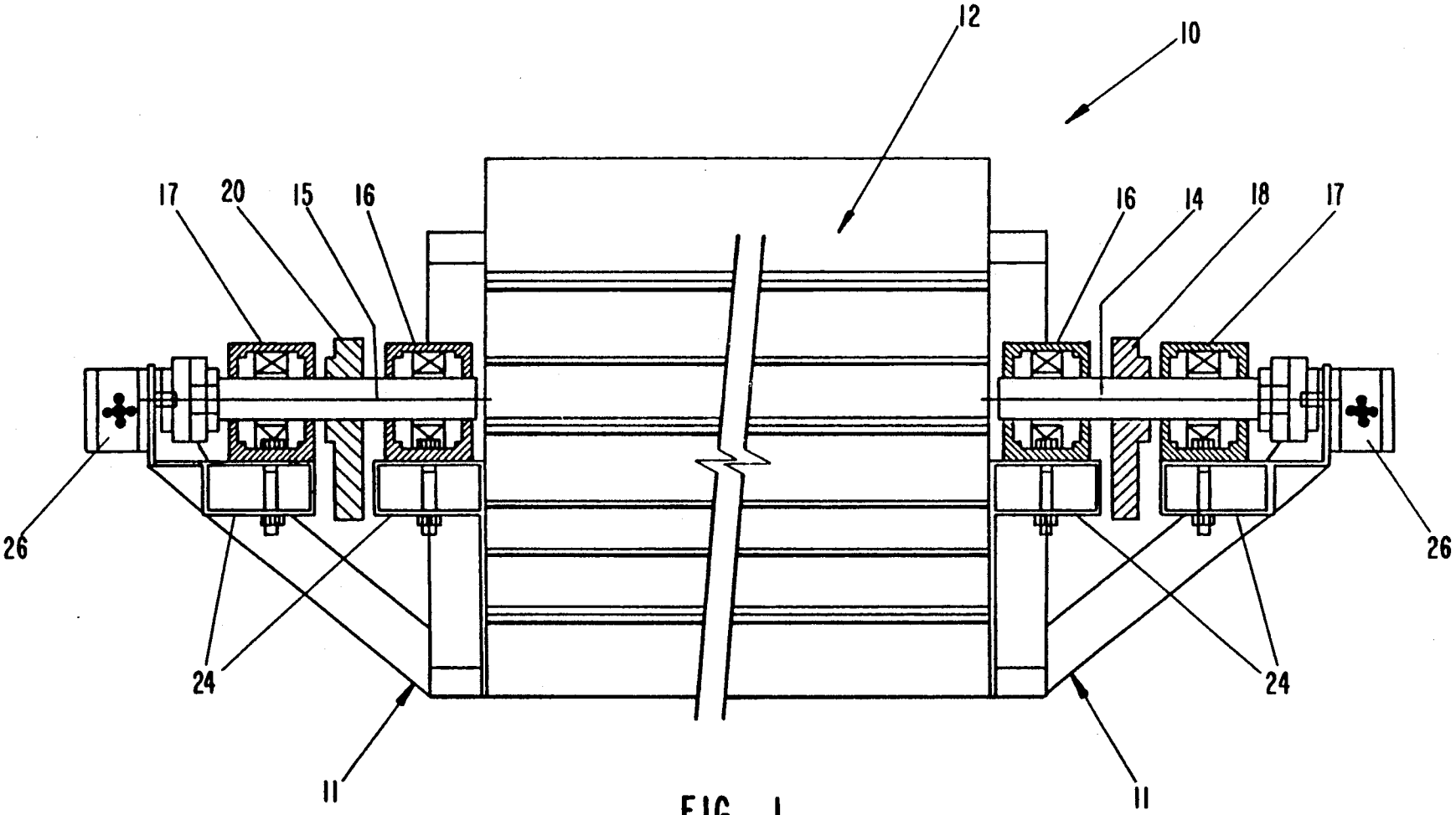
FIG. 1 is a front elevation of a vibratory screening apparatus according to the invention.

Referring now to the drawings, there is shown a preferred embodiment of the vibratory screening apparatus of the present invention. The vibratory screening apparatus is of a type suitable for use in a quarry installation in order to separate out different size portions of material to be screened, such as crushed stone, aggregate and the like. The illustrated preferred embodiment is a multi-deck arrangement of a number of screen meshes arranged one above the other.

However, it should be understood that a single screen comprises a minimum provision of screening in an apparatus according to the invention. The present invention may also have sets of vibratory grid bars.

Specifically in FIG. 1, the apparatus is designated generally by reference 10 and comprises a frame having a pair of opposed screen frame sides 11, and at least one screen which is mounted on the frame sides 11. In the illustrated embodiment, a multi-deck arrangement of screens mounted on frame sides 11 is designated generally by reference 12, and individual screen meshes thereof are designated by reference 13. The multi-deck arrangement of screens 12 will hereinafter be referred to as "screen deck 12."

A shaft-driven vibratory mechanism is coupled with the screen deck 12 in order to impart vibration energy thereto so as to assist the screening operation.

The shaft-driven vibratory mechanism comprises a pair of stubshafts, a first stubshaft 14 extending outwardly from one of the pair of opposed screen frame sides, and a second stubshaft 15 extending outwardly from the opposing frame side. First and second stubshafts 14 and 15 are supported by a respective pair of bearing housings, comprising an inboard housing 16 and outboard housing 17. The inboard housings 16 may comprise so-called "plummer block housings," and the outboard housings 17 may incorporate spherical roller bearings.

A first pair of bearing housings supports the first stubshaft, and a second pair of bearing housings supports the second stubshaft. It will be noted from FIG. 1 that the bearing housings 16 and 17 of each pair are spaced apart from each other, and a respective counterweight is mounted on each stubshaft in the space between housings 16 and 17. A first counterweight 18 is mounted on first stubshaft 14 in the space between bearing housings 16 and 17. A second counterweight 20 is mounted on second stubshaft 15 in the space between bearing housings 16 and 17.

The counterweights 18 and 20 are keyed to each stubshaft so as to be rotatable therewith. Therefore, upon application of drive to each stubshaft 14 and 15, the respective counterweights 18 and 20 are driven in rotation. By virtue of being an offset mass, centrifugal force to each stubshaft which applies vibration energy to each stubshaft, which is then transmitted to screen deck 12 via the bearing housings 16 and 17 and the pair of opposed screen frame sides 11.

Figure 2:
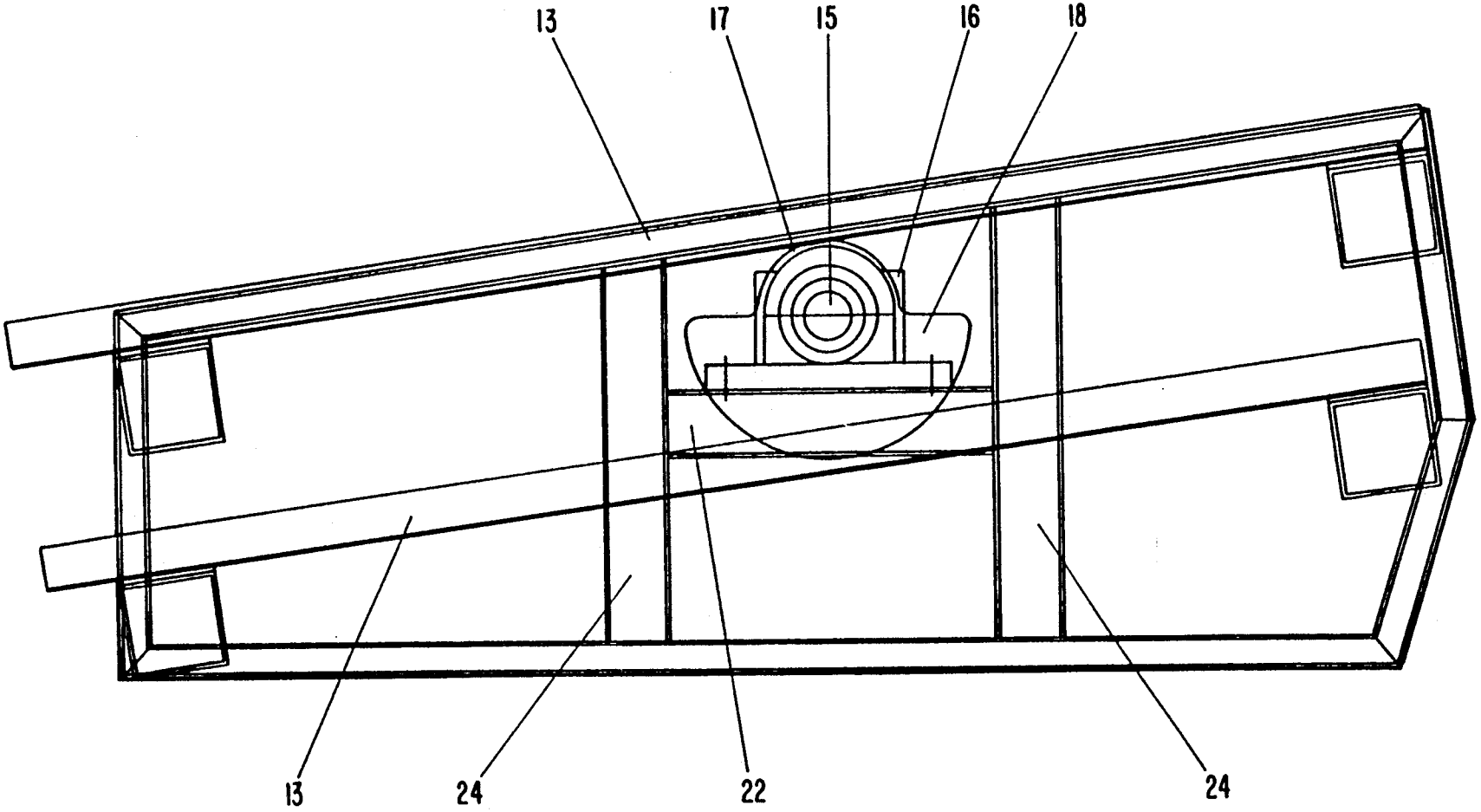
FIG. 2 is a side elevation of the apparatus shown in FIG. 1.

As can be seen in FIG. 2, each of the bearing housings 16 and 17 is rigidly secured to a short length of box-shaped support beam 22 which extends between upright support beams 24 at each frame side of the pair of opposed screen frame sides 11, and which forms part of a rigid frame side support structure.

Drive means is coupled with each stubshaft 14 and 15 for applying rotation thereto. In the embodiment illustrated in FIG. 1, the drive means comprises respective motors 26 coupled to each stubshaft 14 and 15 and arranged to drive the respective stubshafts 14 and 15 in synchronism, with one of the motors applying clockwise rotation and the other applying counter clockwise rotation. The illustration of motors 26 in FIG. 1 is schematic only. Consistent with the teachings of the present invention motors 26 could be any type of drive motor, including synchronous electric motors or hydraulic motors, such as hydraulic motors **26*a* illustrated subsequently in FIG. 3** with an hydraulic circuit therefor.

Typically, stubshafts 14 and 15 may be driven at speeds of the order of about 1,000 rpm. By virtue of the way in which the screen 13 is mounted in the pair of opposed screen frame sides 11 of the apparatus, typical throws, or paths of oscillation imparted to the screen, are about 5 mm . Suitable resilient dampers are arranged to absorb the vibration imparted to the components of the screen.

The illustrated embodiment has been found to provide for efficient transfer of vibration energy to the components of the screen, but in a way which does not apply unduly large bending loads to each stubshaft. This is achieved by virtue of the relatively short lengths of each stubshaft, the mounting of each stubshaft between a pair of spaced bearing housings, and with the counterweight being arranged on each stubshaft in the space between the two housings.

By the above described arrangement, substantial bending stresses generated in an existing design of a long shaft extending throughout the width of the apparatus, which is supported at each shaft end by a single bearing housing, and with the counterweight arranged on the projecting end of the long shaft are avoided. The present invention also avoids the problems of undue deflection which takes place in the mid-region of the long shaft in the existing arrangement.

Figure 3:
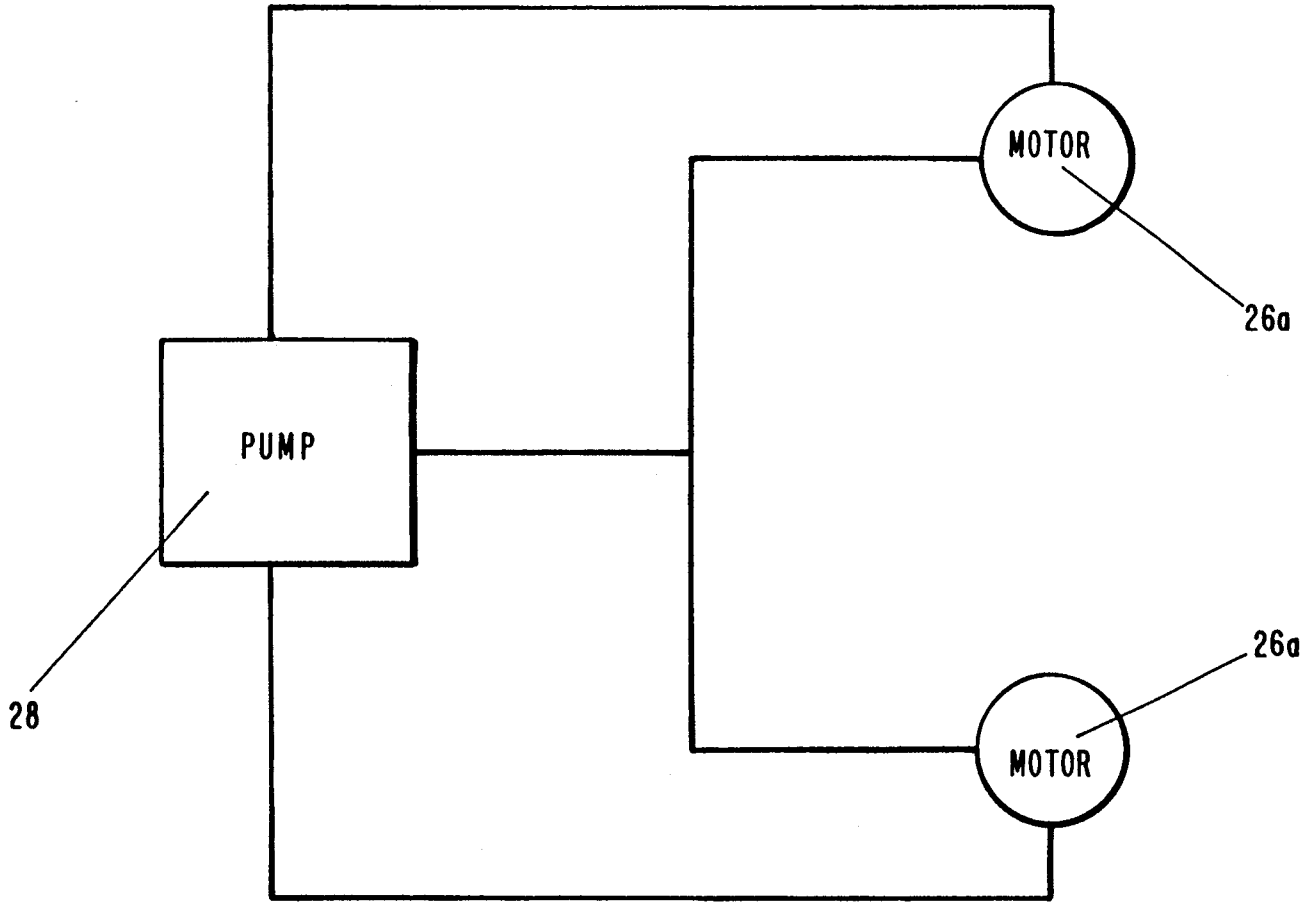
FIG. 3 is a schematic illustration of a pumped hydraulic circuit for operating hydraulic motors which drive the vibratory screening apparatus.

FIG. 3 shows schematically a hydraulic circuit which drives two hydraulic motors 26. In this arrangement, hydraulic motors **26*a* are arranged in parallel to a common pumped supply from one or more pumps 28. Hydraulic motors 26*a* in this arrangement are gear-type hydraulic motors, and the arrangement is such that the motors operate in synchronism with each other. If there should be any tendency for one stubshaft 14 or 15 and its respective counterweights 18 or 20** to get out of phase with the other stubshaft and its respective counterweight, the system self-adjusts or self-compensates (by feedback from the motors) rapidly to get them back in phase.

It has been observed that, even if the shafts should be out of phase on start-up, the system rapidly "tunes" itself and gets the counterweights in phase with each other. This is particularly advantageous, as it provides uniform application of vibration energy to each side frame and then to the screen or screens.

It should be understood that a hydraulic circuit and hydraulic motors are merely one preferred way of providing a self-regulating uniform application of vibration energy to each side of the screen frame in patterns of vibration energy on each side which are in phase with each other. Other drive systems may be provided, including use of synchronous electric motors coupled with the stubshafts 14 and 15.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A vibratory screening apparatus which comprises a frame having a pair of opposed screen frame sides, at least one screen mounted on the pair of opposed screen frame sides, and a shaft-driven vibratory mechanism coupled with at least one screen in order to impact vibration energy thereto so as to assist the screening operation, said mechanism comprising:

a) a first stubshaft and a second stubshaft, the first stubshaft extending outwardly from one of the pair of opposed screen frame sides, and the second stubshaft extending outwardly from the opposing frame side of the pair of opposed screen frame sides;

b) a first pair of bearing housings supporting the first stubshaft, the first pair of bearing housings mounted on the frame side from which the first stubshaft extends outwardly, and the first pair of bearing housings being spaced apart from each other;

c) a second pair of bearing housings supporting the second stubshaft, the second pair of bearing housings mounted on the frame side from which the second stubshaft extends outwardly, and the second pair of bearing housings being spaced apart from each other;

d) a first counterweight mounted on the first stubshaft in the space between the first pair of bearing housings, said first counterweight being rotatable with the first stubshaft in order to apply vibration energy to the first stubshaft and therefrom to at least one screen via the bearing housings and the frame sides;

e) a second counterweight mounted on the first stubshaft in the space between the second pair of bearing housings, said second counterweight being rotatable with the second stubshaft in order to apply vibration energy to the second stubshaft and therefrom to at least one screen via the bearing housings and the frame sides; and f) drive means coupled with each stubshaft for applying rotary motion thereto.

2. A vibratory screening apparatus which comprises a frame having a pair of opposed screen frame sides, at least one screen mounted on the pair of opposed screen frame sides, and a shaft-driven vibratory mechanism coupled with at least one screen in order to impact vibration energy thereto so as to assist the screening operation, said mechanism comprising:

a) a first stubshaft and a second stubshaft, the first stubshaft extending outwardly from one of the pair of opposed screen frame sides, and the second stubshaft extending outwardly from the opposing frame side of the pair of opposed screen frame sides;

b) a first pair of bearing housings supporting the first stubshaft, the first pair of bearing housings mounted on the frame side from which the first stubshaft extends outwardly, and the first pair of bearing housings being spaced apart from each other;

c) a second pair of bearing housings supporting the second stubshaft, the second pair of bearing housings mounted on the frame side from which the second stubshaft extends outwardly, and the second pair of bearing housings being spaced apart from each other;

d) a first counterweight mounted on the first stubshaft in the space between the first pair of bearing housings, said first counterweight being rotatable with the first stubshaft in order to apply vibration energy to the first stubshaft and therefrom to at least one screen via the bearing housings and the frame sides;

e) a second counterweight mounted on the first stubshaft in the space between the second pair of bearing housings, said second counterweight being rotatable with the second stubshaft in order to apply vibration energy to the second stubshaft and therefrom to at least one screen vis the bearing housings and the frames sides; and f) drive means coupled with each stubshaft for applying rotary motion thereto, the drive means comprising a drive motor coupled with the outward free end of each stubshaft arranged to drive the first and second stubshafts in synchronism with each other, so that the same pattern of vibrations are applied to at least one screen at each side thereof.

3. A vibratory screening apparatus as defined in claim 2, wherein each drive motor comprises a hydraulic motor.

4. A vibratory screening apparatus as defined in claim 3, wherein the hydraulic motors are arranged in parallel to a common source of pumped fluid.

5. A vibratory screening apparatus as defined in claim 1, wherein the at least one screen mounted on the pair of opposed screen frame sides comprises a multi-deck screen supported by the pair of opposed screen frame sides wherein each of said bearing housings are mounted on said support beams.

6. A vibratory screening apparatus as defined in claim 1, wherein said first and second pair of bearing housings are mounted on support beams.

7. A vibratory screening apparatus which comprises a frame having a pair of opposed screen frame sides, at least one screen mounted on said frame sides, and a shaft-driven vibratory mechanism coupled with the screen in order to impart vibration energy thereto so as to assist the screening operation, said mechanism comprising:

a) a first stubshaft and a second stubshaft, the first stubshaft extending outwardly from one of the pair of opposed screen frame sides, and the second stubshaft extending outwardly from the opposing frame side of the pair of opposed screen;

b) bearing housings mounted on each frame side supporting each stubshaft;

c) a respective counterweight mounted on each stubshaft and being rotatable therewith in order to apply vibration energy to the stubshaft and therefrom to the screen via the bearing houses; and d) a drive motor coupled with each stubshaft and arranged to apply synchronous rotary motion to each stubshaft.

8. A vibratory screening apparatus as defined in claim 7, in which the drive motors comprise hydraulic motors arranged in parallel to a common pumped supply source.

9. A vibratory screening apparatus as defined in claim 7, in which the motors comprise synchronous electric motors.

10. A vibratory screening apparatus as defined in claim 7, wherein said bearing housings which are mounted on each frame side supporting each stubshaft are spaced apart from each other, and wherein each of said bearing housings are mounted on a support beam forming part of the side frame support structure of the screen.

* * * * *

UNITED STATES PATENT AND TRADEMARK OFFICE

CERTIFICATE OF CORRECTION

PATENT NO. : 5,328,036
DATED : July 12, 1994
INVENTOR(S) : PATRICK J. DOUGLAS

It is certified that error appears in the above-indentified patent and that said Letters Patent is hereby corrected as shown below:

Column 2, line 21, "counter clockwise" should be --counterclockwise--
Column 2, line 54, "typical a throw" should be --a typical throw--
Column 3, line 67, after "force" insert --is applied--
Column 4, line 15, "counter clockwise" should be --counterclockwise--
Column 4, line 21, "an hydraulic" should be --a hydraulic--
Column 4, line 49, "motors 26." should be --motors 26a.--
Column 6, line 28, "vis" should be --via--

Signed and Sealed this

Twenty-first Day of February, 1995

*Attest:*

Bruce Lehman

BRUCE LEHMAN

*Attesting Officer*

*Commissioner of Patents and Trademarks*